US006129294A

United States Patent [19]

Hsin-Fa

[11] Patent Number: 6,129,294

[45] Date of Patent: Oct. 10, 2000

[54] WATER NOZZLE CONTROL VALVE SEAT

[76] Inventor: Wang Hsin-Fa, No. 68, Mou Tan Lane, Shao An Li , Lu Kang Town, Chang Hua Hsien, Taiwan

[21] Appl. No.: 09/188,293

[22] Filed: Nov. 9, 1998

[51] Int. Cl.[7] ..... A62C 5/02

[52] U.S. Cl. ..... 239/310; 293/526

[58] Field of Search ..... 239/310, 526

[56] References Cited

U.S. PATENT DOCUMENTS

| | | | |
|---|---|---|---|
| 2,795,460 | 6/1957 | Bletcher et al. | 239/310 |
| 3,743,186 | 7/1973 | Mocarski | 239/526 |

*Primary Examiner*—Andres Kashnikow
*Assistant Examiner*—Christopher S. Kim
*Attorney, Agent, or Firm*—Harrison & Egbert

[57] ABSTRACT

A water nozzle control valve seat is constructed of a body, a plug tube, a valve tube member, a slide rod, a press rod member, a tension spring, a clip plate, and an elasticity element. The valve seat tube is constructed at the upper section of tubular handle which has provided with an entrance water tube at upper end thereof connecting to the rear bottom of said valve seat tube. An exit water tube is provided between the middle top section of valve seat tube and barrel. An external tube is provided with an opening at bottom front side connecting the exit water tube and barrel. A receiving room of wedge is formed on the water nozzle body located at top and rear side of the external tube. The clip plate is fastened pivotally beneath the barrel locating at front of valve seat tube, and corresponds to the press rod member providing with a wedge hole and further providing with a convex at the bottom section thereof that is relatively to the tubular handle. The elasticity element is located between the clip plate and tubular handle corresponding to the convex so as to enable said clip plate leaning pendulum.

2 Claims, 5 Drawing Sheets

WATER NOZZLE CONTROL VALVE SEAT

FIELD OF THE INVENTION

The present invention relates generally to a water nozzle, and more particularly to a water nozzle control valve seat.

BACKGROUND OF THE INVENTION

In a conventional water nozzle wherein the control lever is pressed by the palm, the thread rod is actuated to trigger the control valve member which is located in the barrel. Such a prior art water nozzle is defective in design since it is not comfortable in operation and further it is not smooth to switch while said water nozzle is spraying.

SUMMARY OF THE INVENTION

The primary objective of the present invention is therefore to provide a water nozzle control valve seat which is stable in installing and leakproof.

In the present invention, the entrance water tube of the bottom valve seat tube is connected to the tubular handle, and the exit water tube of the middle section valve seat tube is connected to the barrel. The external tube extended from the exit water tube inside of barrel is connected with said exit water tube and barrel by the opening and sealed engaging by the plug tube. Moreover, the clip plate of the wedge hole is fastened pivotally at the front of the valve seat tube that is beneath the barrel. An elasticity element is fastened between the bottom section of clip plate and tubular handle corresponding to the convex.

The objective, features and functions of the present invention will be readily understood upon a thoughtful deliberation of the following detailed description of the present invention with reference to the accompanying drawings.

DETAILED DESCRIPTION OF THE INVENTION

Figure 1:
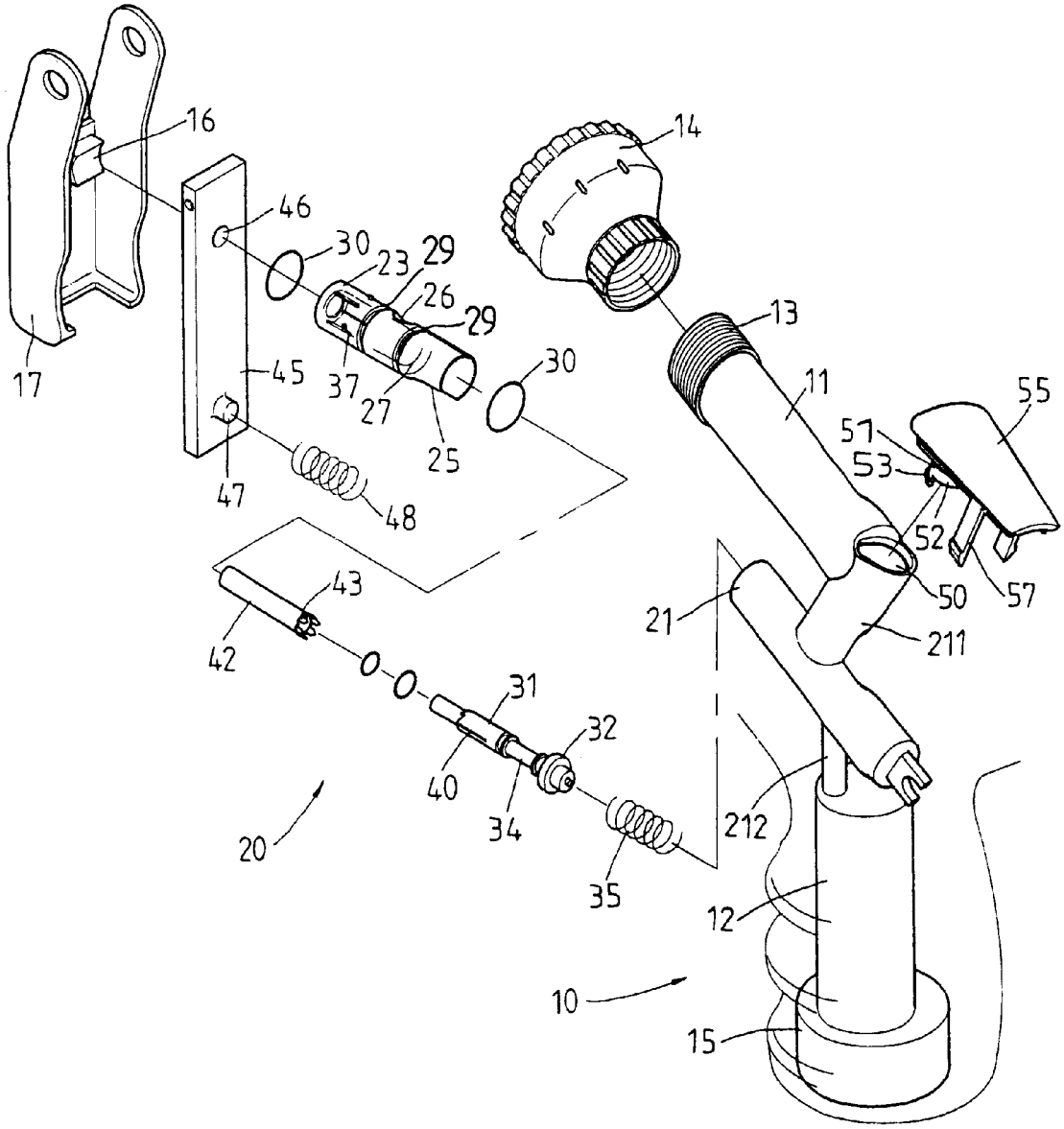
FIG. 1 shows an exploded view of the present invention.
Figure 2:
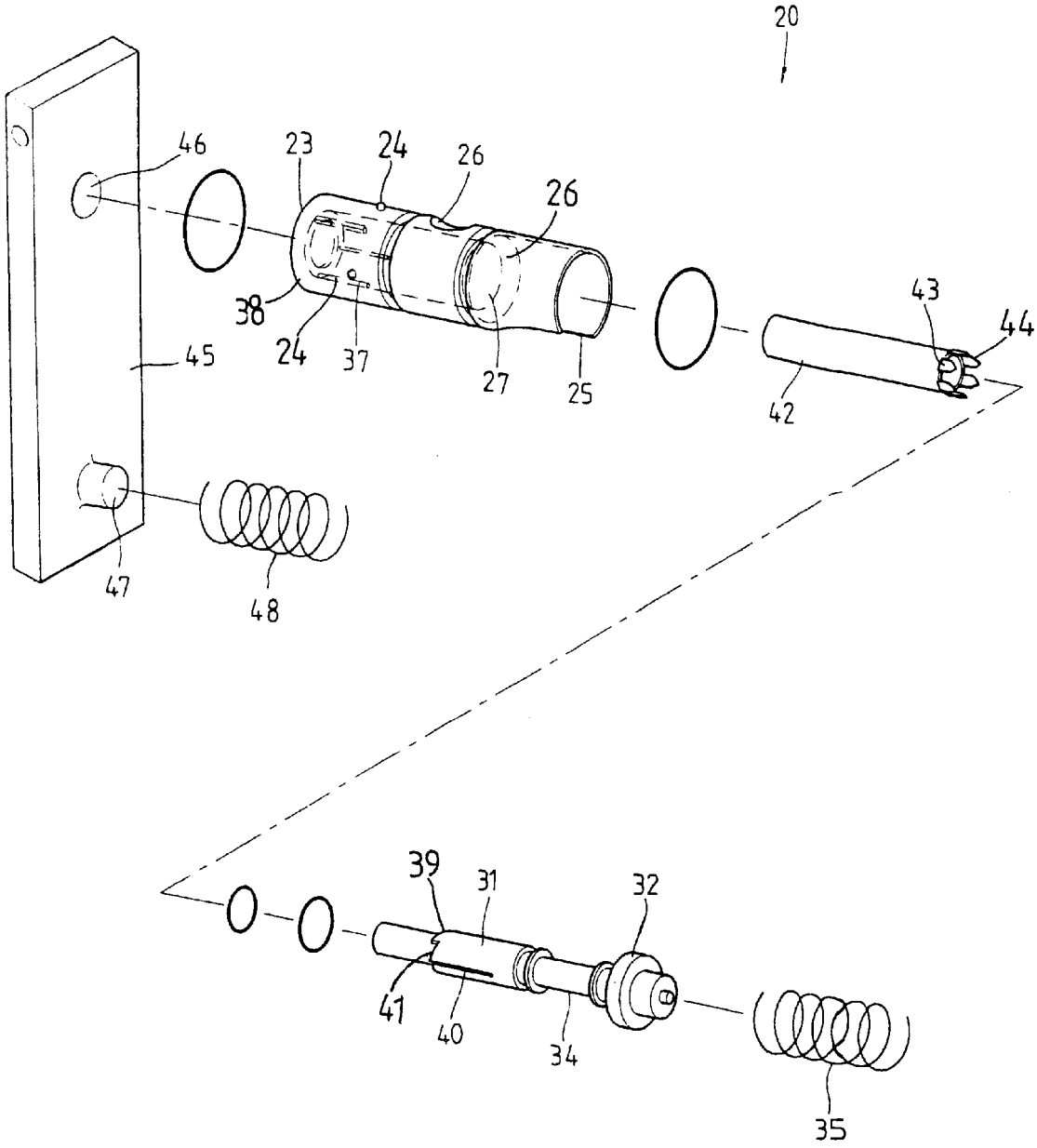
FIG. 2 shows detail exploded view of a water nozzle control valve seat of the present invention.
Figure 3:
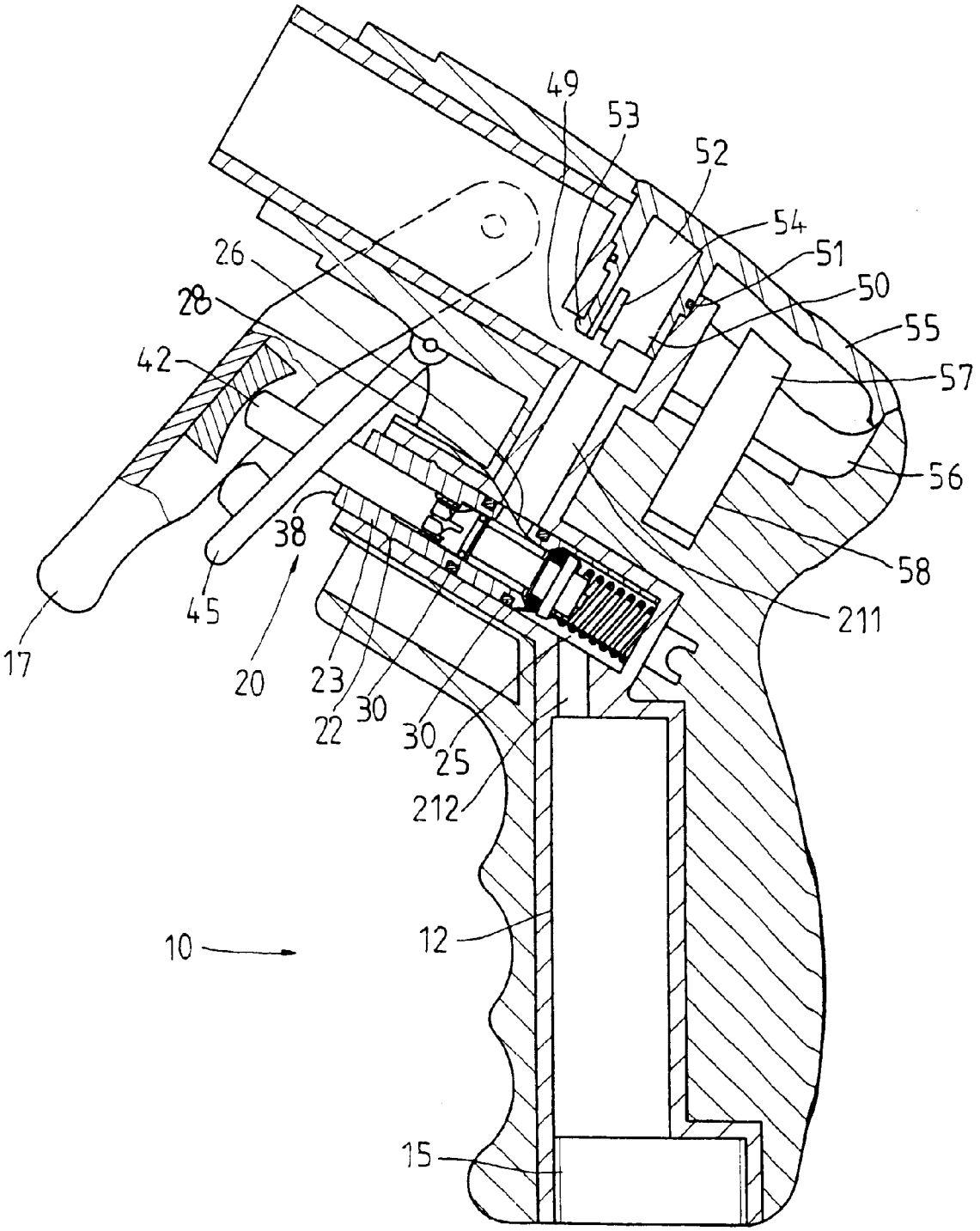
FIG. 3 shows a sectional view of the present invention in combination.
Figure 4:
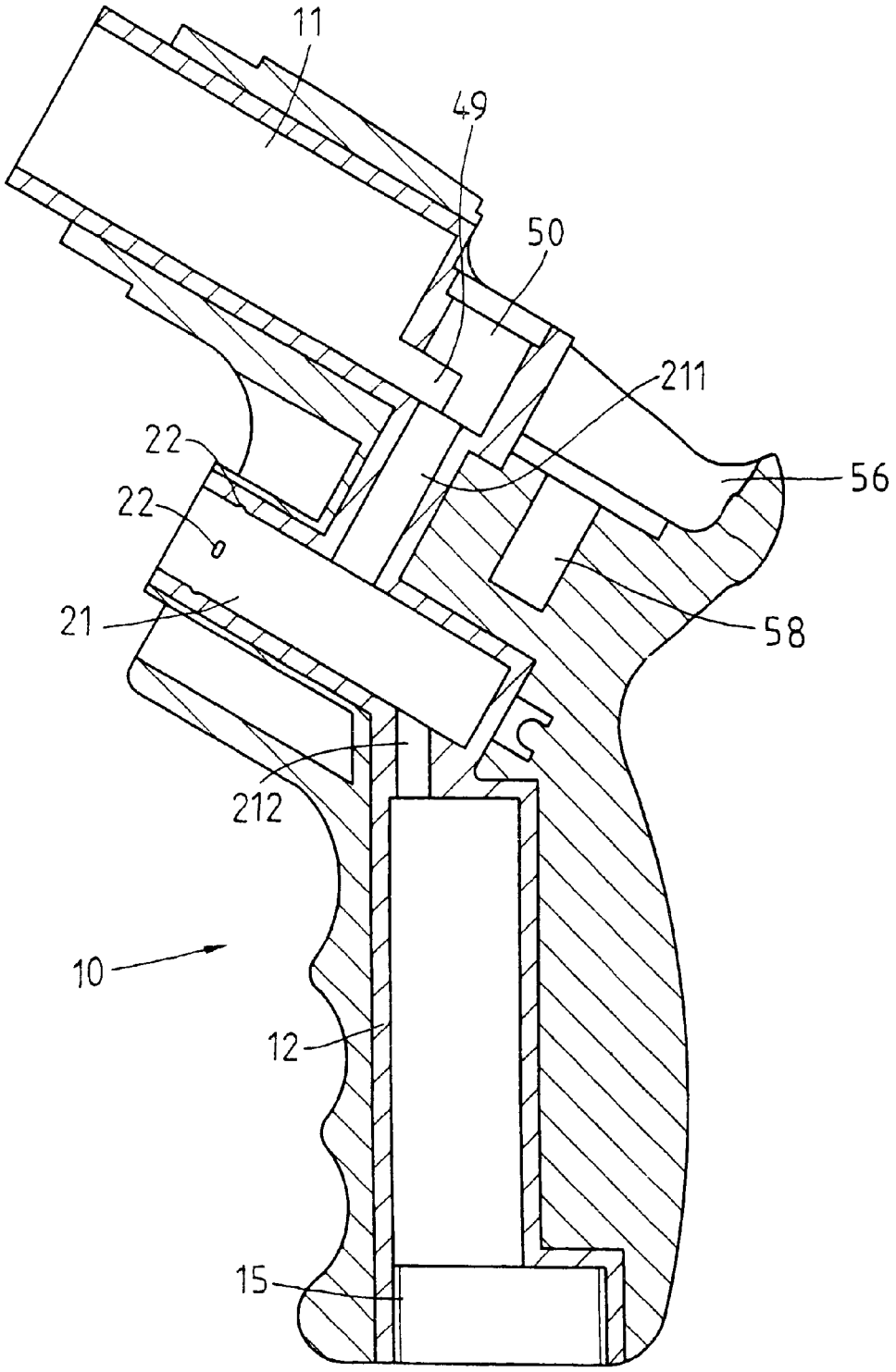
FIG. 4 shows a sectional view of a body of the present invention.
Figure 5:
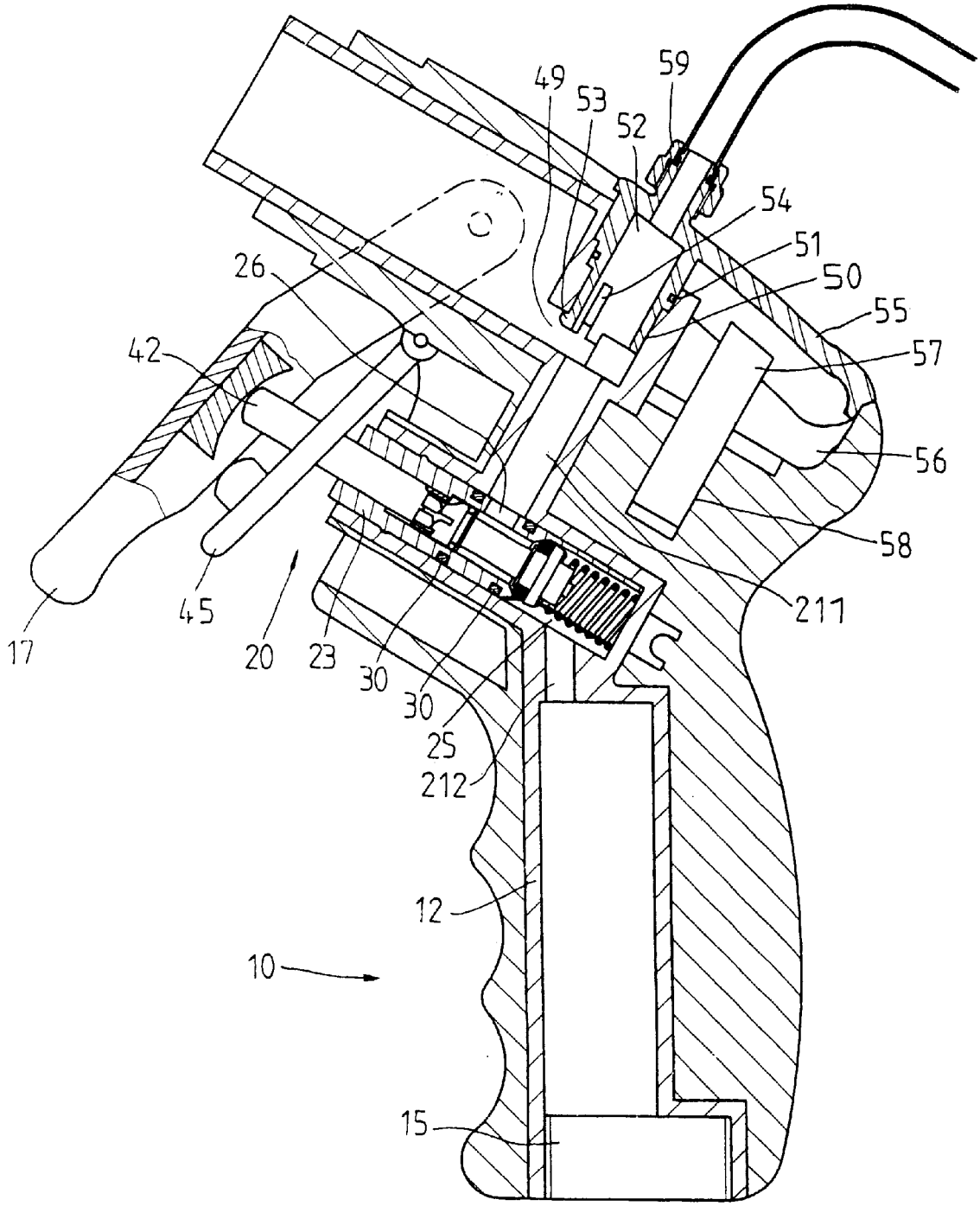
FIG. 5 shows a schematic view of the present invention in operation.

As shown in FIGS. 1–3, the present invention water nozzle control valve seat is constructed of a body 10, a plug tube 52, a valve tube member 23, a slide rod 31, a push rod member 42, a tension spring 35, a clip plate 45, and an spring 48.

The body 10 is of plastic construction and is composed inside of a barrel 11 and a tubular handle 12 which are connected with each other. The barrel 11 is provided with a thread 13 at the front end for engaging with the spray head 14. The tubular handle 12 is also provided with an interiorly threaded member 15 at the bottom end to engage with a water hose. The valve seat tube 21 is affixed to an upper end of tubular handle 12. The top of tubular handle 12 is provided with an entrance water tube 212 which is constructed at the rear bottom of valve seat tube 21. In addition, locating between the middle section of valve seat tube 21 and barrel 11 is an exit water tube 211. The rear of barrel 11 connected to the exit water tube 211 is provided with an external tube 50 which is provided with an opening 49 at the bottom front side connecting the exit water tube 211 with the barrel 11. At the top and rear of external tube 50 located on the body 10 is formed a receptacle 56 for wedge-shaped cavity 58. The valve seat tube 21 is provided in the inner wall of the outer end thereof with two locating cavities 22 symmetrical with each other.

The plug tube 52 is provided with a rubber ring 51 surrounding, and corresponding to the opening 49 of external tube 50 The plug tube 52 has a flange 53 at the bottom end thereof. Both sides of flange 53 are provided with a gap 54 per each side. The top of plug tube 52 is adgacent to the receiving room 56 and has a cover 55 which has two inserting pins 57 for inserting into the wedge-shaped cavity 58, and helping the plug tube 52 to fixedly engage with the external tube 50.

The valve tube member 23 is of a cylindrical construction and is fitted into the valve seat tube 21. The valve tube member 23 is provided in the outer wall thereof with two protuberances 24 which are engaged with the two locating cavities 22 of the valve seat tube 21. The valve tube member 23 is further provided in the inner end thereof with an opening 26 and an indentation 25 which is separated from the opening 26 by a distance. The valve tube member 23 has an axial hole 27 having a circular stepped edge 28, a plurality of ribs 37 and a position confining edge 38. The valve tube member 23 is provided in the periphery thereof with two circular grooves 29 for receiving two leakproof rings 30.

The slide rod 31 is received in the valve tube member 23 such that the rod 31 is located in the slide axial hole 27. The slide rod 31 is provided in the front section thereof with a position confining slot edge 39 and a rib slot 40, which are provided respectively with an angled guide edge 41. The slide rod 31 is provided in the tail end thereof with a stop ring 32 and is further provided in the midsection thereof with a recess 34.

The push rod member 42 is received in the valve tube member 23 and is provided with a plurality of finger 43 having a protruded portion 44 corresponding in location to the angled guide portion 41 of the slide rod 31.

The tension spring 35 is fitted into the rear section of the valve tube member 23 such that the front end of the tension spring 35 urges the stop ring 32 of the slide rod 31 outwardly and, the rear end of the tension spring 35 exerts a force against the wall of the tubular handle 12.

The clip plate 45 is fastened pivotally beneath the barrel 11 and positioned in front of valve seat tube 21. The clip plate 45 has a hole 46 that is aligned with and receives the press rod member 42. The clip plate 45 also has a protrusion 47 formed at the bottom section that faces the tubular handle 12.

The spring 48 is located between the clip plate 45 and tubular handle 12 corresponding to the protrusion 47 so as to enable said clip plate 45 to lean outwardly.

As described above, the water nozzle of the present invention achieves stable installation and is leakproof. The top end of plug tube 52 can also be connected to a connection tube 59 which is connected to a guide tube or external container, so that it can be mixed with fertilizers, disinfectants or cleaners during spraying.

The following is the description of the present invention in operation to achieve its desired effects:

In the present invention, the top of tubular handle 12 is provided with an entrance water tube 212 which communicates with the rear bottom of valve seat tube 21. In addition, an upright exit water tube 211 extends between the middle section of valve seat tube 21 and barrel 11 The exit water tube 211 is provided with an external tube 50 which is provided with an opening 49 at the bottom front side connecting the exit water tube 211 with the barrel 11. The body 10 is convenient to mold and the construction of valve seat tube 21 provides the member of control valve seat 20 stability in installation. Moreover, the exit water tube 211 and entrance water tube 212 correspond to the opening 26 and indentation 25 of valve tube member 23 so that a seal is formed around leakproof rings 30 between valve seat tube 21 and valve tube member 23. Furthermore, the top of external tube 50 is sealed by the plug tube 52 of rubber ring 51.

In the present invention, cover 55 has a plug tube 52 which has, at the bottom end, a flange 53 having gap 54. The cover 55 also has two inserting pins 57 which fit into cavity 58 of receiving room 56. When inserting pins 57 are fixed into cavity 58, plug tub 52 engages and covers opening 49 of external tube 50

The other further feature of the present invention has Furthermore, the top end of plug tube 52 has a connection tube 59 which can be connected with an outer guide tube or external container, so that it can mixed with fertilizers, disinfectants or cleansers The other further feature of the present invention has the clip plate 45 fastened pivotally in a leaning pivotal manner at the front of valve seat tube 21 beneath the barrel 11. A spring 48 is fastened between the bottom section of clip plate 45 and tubular handle 12 corresponding to the protrusion 47, so as to let the urging portion 16 of actuating member 17 move the fingers 43. The hole 46 of clip plate 45 clips fixedly onto the fingers 43. The clip plate is pushed outwardly by tension spring 35 for controlling the quantity of water being sprayed. The fingers 43 can be pushed interiorly to also adjust water quantity. A user can manually release the control valve seat 20 so as to allow the spring 48 to pivot the clip plate 45. If the control valve seat 20 is opened, the fingers 43 need to be pressed once more, to move the end of clip plate 45 to back to its place to prevent the movement of hole 46 towards the fingers 43, so as to let the control valve seat 20 close.

The embodiment of the present invention described above is to be deemed in all respects as being illustrative and not restrictive. Accordingly, the present invention may be embodied in other specific forms without deviating from the spirit thereof. The present invention is therefore to be limited only by the scopes of the following appended claim.

I claim:

1. A water nozzle control valve apparatus comprising:

a body having a plastic exterior, said body having a barrel and a tubular handle interior thereof, said barrel and said tubular handle being connected together, said barrel having a threaded forward end connected to a spray head, said tubular handle having an interiorly threaded bottom end, said threaded bottom end adapted to engage with a water hose, said body having a valve seat tube formed at an upper section of said tubular handle, said body having an entrance water tube connected to a rear bottom of said valve seat tube, said body having an exit water tube connected between a middle section of said valve seat tube and said barrel, said body having an external tube communicating with said exit water tube, said external tube having an opening at a bottom of a front side thereof, said opening of said external tube connecting said exit water tube to said barrel, said body having a receptacle and a wedge-shaped cavity formed at a top and rear of said external tube, said valve seat tube having two locating cavities symmetrical with each other formed on an inner wall at an outer end of said valve seat tube;

a plug tube having a rubber ring extending therearound, said plug tube received by said opening of said external tube, said plug tube having a flange at a bottom end thereof, said plug tube having a gap on respective opposite sides of said flange, said plug tube having a top adjacent to said receptacle, said top having a cover thereover, said cover having two pins inserted into said wedge-shaped cavity, said plug tube being fixedly engaged with said external tube;

a cylindrical valve tube member having protuberances formed on an outer wall thereof, said valve tube member fitted into said valve seat tube such that said protuberances are retained respectively in said two locating cavities of said valve seat tube, said valve tube member having an opening and an indentation formed on an inner end thereof, said valve tube member having an axial hole with a circular stepped edge formed therein, said valve tube member having a plurality of ribs and position confining edge formed in said axial hole, said valve tube member having two circular grooves formed therearound, said two circular grooves respectively receiving two leakproof rings therein;

a slide rod received within said axial hole of said valve tube member, said slide rod having a position confining slot edge and a rib slot formed thereon, said rib slot having an angled guide edge, said slide rod having a stop ring formed on one end theoef and said slide rod having a recess formed in a midsection thereof;

a push rod member received in said valve tube member, said push rod member having a plurality of fingers each having a protruded portion, said plurality of fingers cooperatively arranged against said angled guide portion of said slide rod;

a tension spring fitted into said valve tube member such that one end of said tension spring exerts a force against said stop ring of said slide rod and such that an opposite end of said tension spring exerts a force against said tubular handle;

a clip plate fastened pivotally beneath said barrel forward of said valve seat tube, said clip plate having a hole aligned with and receiving said push rod member, said clip plate having a protrusion at a bottom section thereof which faces said tubular handle; and a spring element positioned between said clip plate and said tubular handle, said spring connected to said protrusion of said clip plate so as to cause said clip plate to lean pivotally.

2. The apparatus of claim 1, said top end of said plug tube being connected to a connection tube, said connection tube adapted to pass fluids from another tube or an external container.

* * * * *